US005851409A

United States Patent [19]

Schaeffer et al.

[11] Patent Number: 5,851,409

[45] Date of Patent: Dec. 22, 1998

[54] METHOD FOR REMOVING AN ENVIRONMENTAL COATING

[75] Inventors: Jon C. Schaeffer, Milford; Jeffrey A. Conner, Hamilton; Dennis P. Dry, Cincinnati; Gregory J. Anselmi, Fairfield, all of Ohio; David C. Zigan, Episy, France

[73] Assignee: General Electric Company, Cincinnati, Ohio

[21] Appl. No.: 772,959

[22] Filed: Dec. 24, 1996

[51] Int. Cl.[6] ..... C23F 4/00

[52] U.S. Cl. ..... 216/2; 156/645.1; 156/654.1; 156/655.1; 156/656.1; 216/52

[58] Field of Search ..... 156/645.1, 654.1, 156/655.1, 656.1; 216/2, 52

[56] References Cited

U.S. PATENT DOCUMENTS 4,032,359 6/1977 Fisher et al. ..... 134/3

4,889,589 12/1989 McComas ..... 156/646

5,614,054 3/1997 Reeves et al. ..... 156/344

*Primary Examiner*—Christopher L. Chin

*Attorney, Agent, or Firm*—Andrew C. Hess; David L. Narciso

[57] ABSTRACT

A method for removing an environmental coating on an article intended for use in a hostile environment, such as turbine, combustor and augmentor components of a gas turbine engine. The method is particularly suited for the repair of diffusion aluminide coatings covered by a protective oxide scale, which may further include a thermal insulating ceramic outer layer. Processing steps generally include peening the environmental coating at a temperature below the ductile-to-brittle transition temperature of the diffusion coating, such that cracks are formed in the diffusion coating. Thereafter, the diffusion coating is subjected to an acidic solution that penetrates the cracks and interacts with the coating diffusion zone, resulting in the diffusion coating being chemically stripped from its underlying substrate.

20 Claims, 1 Drawing Sheet

METHOD FOR REMOVING AN ENVIRONMENTAL COATING

This invention relates to diffusion coatings for components exposed to oxidizing environments, such as the hostile thermal environment of a gas turbine engine. More particularly, this invention is directed to a method for rapidly removing a diffusion coating from a substrate without damaging the substrate.

BACKGROUND OF THE INVENTION

The operating environment within a gas turbine engine is both thermally and chemically hostile. Significant advances in high temperature alloys have been achieved through the formulation of iron, nickel and cobalt-base superalloys, though components formed from such alloys often cannot withstand long service exposures if located in certain sections of a gas turbine engine, such as the turbine, combustor and augmentor. A common solution is to protect the surfaces of such components with an environmental coating, i.e., a coating that is resistant to oxidation and hot corrosion.

Coating materials that have found wide use for this purpose include diffusion aluminide coatings formed by diffusion processes, such as a pack cementation process. Such diffusion processes generally entail reacting the surface of a component with an aluminum-containing gas composition to form two distinct zones, the outermost of which is an additive layer containing an environmentally-resistant intermetallic represented by MAl, where M is iron, nickel or cobalt, depending on the substrate material. The chemistry of the additive layer will also be modified by the presence in the aluminum-containing composition of additional elements, such as chromium, silicon, platinum, rhodium, hafnium, yttrium and zirconium. Beneath the additive layer is a diffusion zone comprised of various intermetallic and metastable phases that form during the coating reaction as a result of diffusional gradients and changes in elemental solubility in the local region of the substrate. During high temperature exposure in air, the MAl intermetallic forms a protective aluminum oxide (alumina) scale that inhibits oxidation of the diffusion coating and the underlying substrate.

For particularly high temperature applications, environmental coatings further include a layer of thermal insulating ceramic over a diffusion coating. Various ceramic materials have been employed for this purpose, particularly zirconia ($ZrO_2$) that is partially or fully stabilized by yttria ($Y_2O_3$), magnesia (MgO) or another oxide. These particular materials are widely employed in the art because they can be readily deposited by plasma spray, flame spray and vapor deposition techniques.

Though significant advances have been made with environmental coating materials and processes for forming such coatings, there is the inevitable requirement to repair these coatings under certain circumstances. For example, removal may be necessitated by erosion or thermal degradation of the diffusion coating, refurbishment of the component on which the coating is formed, or an in-process repair of the diffusion coating or its overlying ceramic layer (if present). The current state-of-the-art repair method for removing a diffusion aluminide coating is to remove any oxide scale or ceramic layer present on the diffusion coating, followed by treatment with an acidic solution capable of interacting with and removing the additive layer and then the diffusion zone. This process relies on lengthy exposures to stripping chemicals, often at elevated temperatures, that can cause significant attack of the underlying metallic substrate, such as alloy depletion and intergranular or interdendritic attack. Substrate attack is most severe when a component being stripped has regions with different coating thicknesses or has uncoated surface regions, such as the dovetail of a turbine blade. A thicker coating requires longer exposure than does a thinner coating, with the result that the substrate beneath a thinner coating can be exposed to attack by the stripping solution for a significant length of time. To protect uncoated surface regions, mask material capable of enduring extended exposures to the stripping solution are required to prevent substrate attack.

Another drawback of prior art stripping techniques is that dedicated equipment must be available to obtain the benefit of more rapid reaction rates achieved at elevated temperatures. Specifically, the use of acidic solutions at elevated temperatures requires expensive ventilation and scrubbing systems to handle fumes generated during the extended stripping process required by the prior art.

From the above, it can be appreciated that the prior art lacks a process for rapidly removing a diffusion coating without posing a significant risk to the substrate material. If such a process were available, the labor, processing and costs required to refurbish and/or repair diffusion coatings could be significantly reduced.

SUMMARY OF THE INVENTION

It is an object of this invention to provide a method for removing an environmental coating from an article of the type used in hostile environments.

It is another object of this invention that such a method is applicable to environmental coatings formed by a diffusion coating with or without an overlying insulating ceramic layer.

It is yet another object of this invention that the method limits attack of the substrate underlying the coating, and therefore avoids damage to the substrate.

The present invention generally provides a method of removing an environmental coating on an article designed for use in a hostile environment, such as turbine, combustor and augmentor components of a gas turbine engine. The method is particularly suited for the removal of environmental coatings formed by a diffusion aluminide coating covered by a protective oxide scale, and that may further include a thermal insulating ceramic outer layer. The processing steps of this invention generally include peening the environmental coating at a temperature below the ductile-to-brittle transition temperature of the coating, such that cracks are formed in the diffusion coating. According to this invention, the peening step can be performed by a variety of techniques, including but not limited to shot peening with steel, glass or ceramic shot, flapper, gravity, wet peening and other mechanical techniques, as well as nonmechanical means such as laser shocking of the surface. Thereafter, the environmental coating is subjected to an acidic solution that penetrates the cracks and interacts with the diffusion zone (the region of the diffusion coating between the substrate and the additive layer at the surface of the article), resulting in the diffusion coating being chemically stripped from its underlying substrate. The peening operation also serves to fracture and remove any oxide scale and/or ceramic layer present on the diffusion coating.

According to this invention, the cracks created by the peening operation provide multiple passages through which the stripping solution is able to penetrate the additive layer of the diffusion coating and react with the underlying diffusion zone. As such, the stripping solution is not required to gradually remove the diffusion coating as it progressively reacts with the outermost exposed surface of the coating, as is required by the prior art. As a result, the time required to strip the coating is significantly reduced, which considerably lessens the criticality of masking any uncoated surface regions of an article. Importantly, the cracks also eliminate the influence of variations in coating thickness, since the stripping solution simultaneously penetrates to the diffusion zone of all regions of the coating, regardless of the thickness of the coating in a particular region. As a result, the likelihood of the substrate being subjected to attack by the stripping solution is reduced considerably.

The peening operation also enables the stripping operation to be performed at approximately room temperature, in contrast to prior art methods that require elevated temperatures. This aspect of the invention further lessens the criticality of masking any uncoated surface regions of an article. Finally, any oxide scale or ceramic layer need not be removed prior to the stripping operation, since the peening operation can be performed to yield cracks that extend through all layers of the environmental coating system. As a result of this invention, the labor, processing and costs required to remove and repair an environmental coating are significantly reduced.

Other objects and advantages of this invention will be better appreciated from the following detailed description.

BRIEF DESCRIPTION OF THE DRAWINGS

The present invention will now be described, by way of example, with reference to the accompanying drawings, in which.

DETAILED DESCRIPTION OF THE INVENTION

Figure 1:
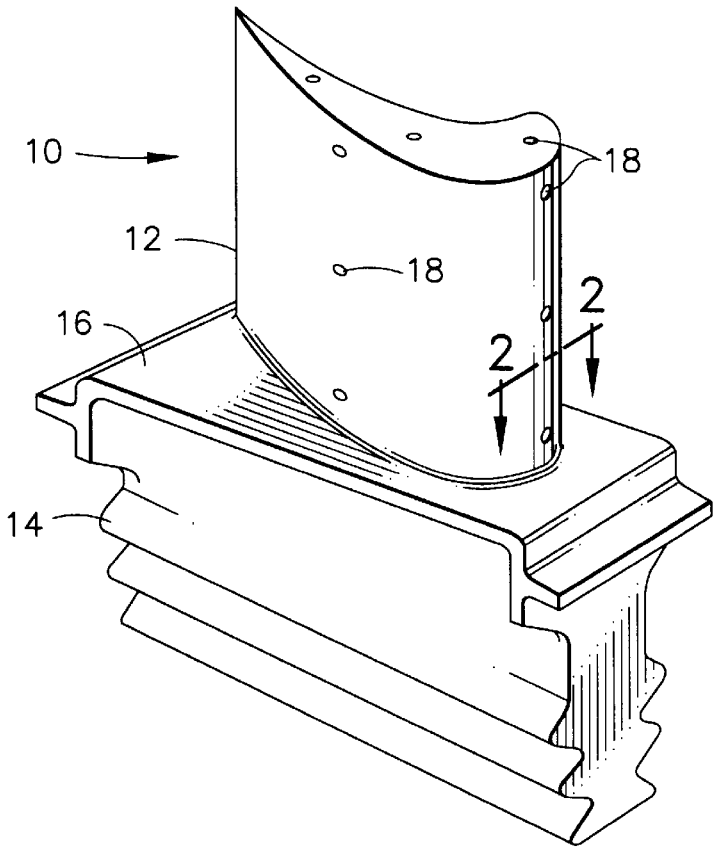
FIG. 1 is a perspective view of a high pressure turbine blade.

The present invention is generally applicable to metal components that operate within environments characterized by relatively high temperatures, and are therefore subjected to a hostile oxidizing environment. Notable examples of such components include the high and low pressure turbine nozzles and blades, shrouds, combustor liners and augmentor hardware of gas turbine engines. One such example is an integrally-manufactured high pressure turbine blade 10 shown in FIG. 1. The blade 10 generally includes an airfoil 12 and platform 16 against which hot combustion gases are directed during operation of the gas turbine engine, and whose surfaces are therefore subjected to severe attack by oxidation, corrosion and erosion. The airfoil 12 and platform 16 are anchored to a turbine disk (not shown) with a dovetail 14 formed on a shank section of the blade 10. Cooling passages 18 are present through the airfoil 12 through which bleed air is forced to transfer heat from the blade 10. While the advantages of this invention will be described with reference to the high pressure turbine blade 10 shown in FIG. 1, the teachings of this invention are generally applicable to any component on which an environmental coating may be used to protect the component from its environment.

Figure 2:
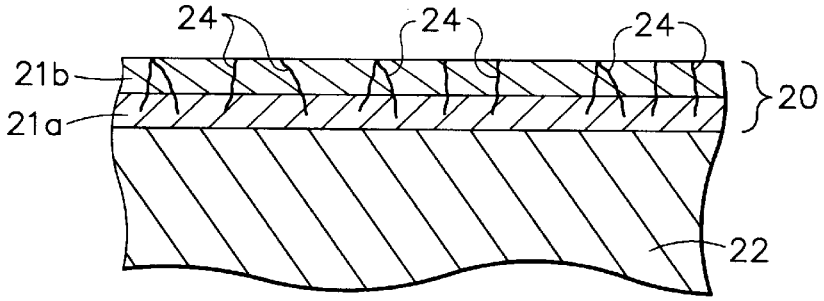
FIG. 2 is a cross-sectional view of the blade of FIG. 1 along line 2—2, and represents the appearance of a diffusion coating on the blade during processing in accordance with this invention.

The method of this invention is particularly suited for the removal of a diffusion aluminide coating on the surface of an article, such as the blade 10 depicted in FIG. 1. A diffusion aluminide coating 20 and its underlying substrate 22 are represented in FIG. 2 as a cross-section of the blade 10 of FIG. 1. As represented, the aluminide coating 20 includes a diffusion zone 21*a* and an additive layer 21*b*, the latter of which is usually a monoaluminide layer of the oxidation-resistant MAl intermetallic phase. Coatings of this type form an aluminum oxide scale (not shown) on the surface of the additive layer 21*b* during exposure to engine environments, which inhibits oxidation of the coating 20 and substrate 22. The invention is also applicable to such diffusion coatings when covered by an insulating ceramic layer, as is the situation with high temperature components of a gas turbine engine. Typical substrate materials for the blade 10 include nickel-base and cobalt-base superalloys, though it is foreseeable that other materials could be used. If the blade 10 is formed of a nickel-base superalloy, the additive layer 21*b* will contain the nickel-aluminide beta phase (NiAl), which is a particularly oxidation-resistant intermetallic phase. The thickness of the diffusion coating 20 is typically about 50 to about 125 micrometers. Preferred methods for forming the diffusion coating 20 include pack cementation, above-pack and chemical vapor deposition techniques, though it is foreseeable that other techniques could be used.

If present, the ceramic layer may have a strain-tolerant columnar grain structure achieved by physical vapor deposition techniques known in the art, e.g., electron beam physical vapor deposition (EBPVD). A suitable material for the ceramic layer is zirconia partially or fully stabilized with yttria (YSZ), though other ceramic materials could be used, including nonstabilized zirconia, or zirconia fully or partially stabilized by ceria ($CeO_2$) or scandia ($Sc_2O_3$). These ceramic materials are typically deposited to a thickness of about 75 to about 300 micrometers.

The method of this invention entails developing cracks 24 in and through the diffusion coating 20, followed by exposure to a chemical stripping solution that penetrates the cracks 24 to react with the diffusion zone 21*a* between the additive layer 21*b* and the underlying substrate 22, with the result that the diffusion coating 20 is stripped from the substrate. The cracks 24 may be developed by a variety of techniques, including but not limited to shot peening with steel, glass or ceramic particles, flapper, gravity, wet peening and other mechanical techniques, as well as nonmechanical means such as laser shocking of the surface. Preferably, the cracks 24 extend entirely through the additive layer 21*b* and into the diffusion zone 21*a*, as depicted in FIG. 2. In order to develop a network of cracks 24 that adequately provide access to the diffusion zone through a diffusion coating 20 whose thickness may vary, the peening operation is performed under controlled-intensity conditions with respect to the velocity, hardness, size and weight of the shot media and the impingement angle of the media with the surface. The peening operation can also be suitably adjusted to fracture and remove any oxide scale and/or ceramic layer that may be present on the diffusion coating 20. Finally, the peening operation is performed at a temperature below the ductile-to-brittle transition temperature (DBTT) of the diffusion coating 20, which is typically about 650° C. to about 760° C. for diffusion aluminide alloys of the type used to form oxidation-resistant diffusion coatings for gas turbine engine components. This aspect of the invention promotes the formation of cracks 24 without unnecessarily working or damaging the underlying substrate 22.

Once cracks 24 are developed in the coating 20, the coating 20 is exposed to a chemical stripping solution, which is preferably an acid diluted in water. Suitable acids include hydrochloric (HCl), nitric ($HNO_3$) and phosphoric ($H_3PO_4$) acids alone or in combination. A preferred acid for a given application will depend on the particular material of the substrate 22. For example, the nickel-base superalloy designated as Rene 80 can be stripped of a diffusion aluminide coating using a 50/50 mixture of nitric and phosphoric acids.

During evaluations of this invention, diffusion aluminide coatings on a number of high pressure turbine blades were removed using a process in accordance with this invention. The blades were mechanically peened at room temperature, and therefore below the ductile-to-brittle transition temperature of the diffusion coatings. The peening media was S110 cast steel shot having a hardness of greater than about $R_C$ 45, and peening was performed at an intensity of about 0.1 to about 0.2 millimeter (about 0.004 to about 0.008 inch) A, which quantifies the extent to which an Almen test strip deflects when peened at or above a saturation level. See ASM Metals Handbook, 9th Edition, Volume 5. The peening operation developed visible cracks that penetrated into the diffusion zone.

A portion of the surface area of each blade was then masked with a combination of lacquer and wax, and the blades were immersed in an acidic bath of 50 volume percent water and 50 volume percent hydrochloric acid (technical or reagent grade at a concentration of 35.0 to 38.0 weight percent hydrochloric acid) at room temperature. The blades underwent one or more immersion cycles to evaluate the impact of lengthened exposure to the stripping solution. Thereafter, the blades were rinsed with hot water and the stripping masks were removed by melting in a low temperature furnace followed by burnout at a higher temperature.

At the completion of this process, all of the exposed blade surfaces were free of remnants of the diffusion coatings. Based on the results obtained by employing a different number of immersion cycles on the blades, it was determined that exposure times of as short as fifteen minutes were sufficient to completely remove the aluminide coatings on the blade. Notably, because the stripping operation was performed at room temperature, exposure times of 120 minutes resulted in minimal alloy depletion and intergrannular/interdendritic attack of the underlying superalloy substrates, as determined by destructive evaluation. In addition, destructive evaluation of some of the blades evidenced that the peening operation did not damage the substrate material underlying the diffusion coatings. Consequently, this invention was shown to enable the rapid removal of a diffusion aluminide coating with negligible impact on the substrate on which the coating is formed. Due to the rapid removal rate and the relatively benign impact of the stripping solution on the substrates at room temperature, this invention permits uncoated surface regions to come into contact with a stripping solution for a duration sufficient to remove an aluminide coating on adjacent surface regions. Therefore, the cost and time of masking uncoated surface regions of an article can be completely eliminated by the implementation of this invention.

In summary, it was apparent that the peening operation produced a sufficient network of cracks that enabled the stripping solution to penetrate to the diffusion zone beneath the additive layer of each coating. Adequacy of the cracks was evidenced by the rapid removal of the coating as compared to prior art processes, and by the uniformity with which the coatings were removed regardless of coating thickness. The effectiveness of the cracks was also evidenced by the ability to perform the stripping operation at room temperature. Notably, prior art stripping operations are traditionally performed at temperatures of at least about 70° C. in order to achieve minimum stripping times of typically about three hours.

While our invention has been described in terms of a preferred embodiment, it is apparent that other forms could be adopted by one skilled in the art. For example, it is foreseeable that this invention could be applied to other types of diffusion coatings. Accordingly, the scope of our invention is to be limited only by the following claims.

What is claimed is:

1. A method for removing an environmental coating on a metallic substrate, the method comprising the steps of:

providing a metallic substrate having a diffusion coating comprising an additive layer and a diffusion zone between the additive layer and the substrate;

developing cracks in the diffusion coating at a temperature less than the ductile-to-brittle transition temperature thereof; and then subjecting the diffusion coating to an acidic solution that penetrates the cracks and interacts with the diffusion zone so as to chemically strip the diffusion coating from the substrate.

2. A method as recited in claim 1 wherein the developing step entails peening a surface of the diffusion coating.

3. A method as recited in claim 1 wherein the diffusion coating further comprises a thermally-grown oxide layer on a surface thereof, and wherein the developing step entails peening the oxide layer.

4. A method as recited in claim 1 wherein the metallic substrate further includes a ceramic layer overlying the diffusion coating, and wherein the developing step entails peening the ceramic layer.

5. A method as recited in claim 4 wherein the ceramic layer is fractured and removed during the developing step.

6. A method as recited in claim 1 wherein the step of subjecting the diffusion coating to the acidic solution is performed at approximately room temperature.

7. A method as recited in claim 1 wherein at least some of the cracks formed by the developing step extend completely through the additive layer to the diffusion zone.

8. A method as recited in claim 1 wherein the diffusion coating contains an MAl intermetallic phase, where M is iron, nickel or cobalt.

9. A method as recited in claim 1 wherein the developing step entails impacting the diffusion coating with particles.

10. A method as recited in claim 1 wherein the developing step entails nonmechanical impacting of the diffusion coating.

11. A method for removing an environmental coating on a metallic substrate, the method comprising the steps of:

providing a metallic substrate having a diffusion aluminide coating comprising an aluminide-containing additive layer and a diffusion zone between the additive layer and the substrate;

mechanically peening the diffusion aluminide coating at a temperature less than the ductile-to-brittle transition temperature thereof so as to form cracks through the additive layer; and then subjecting the diffusion aluminide coating to an acidic solution that penetrates the cracks and interacts with the diffusion zone so as to chemically strip the diffusion aluminide coating from the substrate.

12. A method as recited in claim 11 wherein the diffusion aluminide coating is directly impacted during the peening step.

13. A method as recited in claim 11 wherein the diffusion aluminide coating further comprises a thermally-grown oxide layer on a surface thereof, the oxide layer being impacted during the peening step.

14. A method as recited in claim 11 wherein the metallic substrate further includes a ceramic layer overlying the diffusion aluminide coating, the ceramic layer being impacted during the peening step.

15. A method as recited in claim 14 wherein the ceramic layer is fractured and removed during the peening step.

16. A method as recited in claim 11 wherein the step of subjecting the diffusion aluminide coating to the acidic solution is performed at approximately room temperature.

17. A method as recited in claim 11 wherein at least some of the cracks formed by the shot peening step extend completely through the additive layer to the diffusion zone.

18. A method as recited in claim 11 wherein the peening step entails impacting the diffusion aluminide coating with particles at an intensity level of about 0.1 to about 0.2 millimeter A.

19. A method as recited in claim 11, further comprising the step of masking the diffusion aluminide coating so as to limit the peening and subjecting steps to a surface portion thereof.

20. A method for removing an environmental coating on a component of a gas turbine engine, the method comprising the steps of:

providing a gas turbine engine component having a diffusion aluminide coating comprising an aluminide-containing additive layer and a diffusion zone;

shot peening the diffusion aluminide coating at a temperature less than the ductile-to-brittle transition temperature thereof so as to form cracks that extend through the additive layer to the diffusion zone; and then subjecting the diffusion aluminide coating to an acidic solution at approximately room temperature, the acidic solution penetrating the cracks and interacting with the diffusion zone so as to chemically strip the diffusion aluminide coating from the component.

* * * * *